US011478116B2

(12) United States Patent
Conrad

(10) Patent No.: US 11,478,116 B2
(45) Date of Patent: Oct. 25, 2022

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc, Hampton (CA)

( * ) Notice: Subject to any disclaimer, the term of this patent is extended or adjusted under 35 U.S.C. 154(b) by 868 days.

(21) Appl. No.: 15/871,657

(22) Filed: Jan. 15, 2018

(65) Prior Publication Data

US 2019/0216280 A1 Jul. 18, 2019

(51) Int. Cl.

| | |
|---|---|
| ***A47L 9/12*** | (2006.01) |
| ***A47L 5/24*** | (2006.01) |
| ***A47L 9/16*** | (2006.01) |

(52) U.S. Cl.

CPC *A47L 9/12* (2013.01); *A47L 5/24* (2013.01); *A47L 9/1608* (2013.01); *A47L 9/1633* (2013.01); *A47L 9/1641* (2013.01); *A47L 9/1666* (2013.01); *A47L 9/1683* (2013.01)

(58) Field of Classification Search

CPC ..... A47L 9/12; A47L 9/127; A47L 9/1658; A47L 9/1666; A47L 5/24

USPC ..... 15/344

See application file for complete search history.

(56) References Cited

U.S. PATENT DOCUMENTS

| | | | |
|---|---|---|---|
| 2,233,167 | A | 2/1941 | Holm-Hansen |
| 3,002,215 | A | 10/1961 | MacFarland |
| 3,320,727 | A | 5/1967 | Farley et al. |
| 3,870,486 | A | 3/1975 | Eriksson et al. |
| 3,877,902 | A | 4/1975 | Eriksson et al. |
| 4,991,253 | A | 2/1991 | Rechsteiner |
| 5,078,761 | A | 1/1992 | Dyson |

(Continued)

FOREIGN PATENT DOCUMENTS

| | | | |
|---|---|---|---|
| GB | 1386055 | A | 3/1975 |
| GB | 2372431 | A | 8/2002 |

(Continued)

*Primary Examiner* — Brian D Keller

*Assistant Examiner* — Aaron R McConnell

(74) *Attorney, Agent, or Firm* — Philip C. Mendes da Costa; Bereskin & Parr LLP/S.E.N.C.R.L., s.r.l.

(57) ABSTRACT

A hand vacuum cleaner having a front end and a rear end positioned in a rearward direction rearward of the front end is described herein. The hand vacuum cleaner includes a dirty fluid inlet, an air treatment member downstream of the dirty fluid inlet, a pre-motor filter positioned in a pre-motor filter housing downstream from the air treatment member, a suction motor downstream of the pre-motor filter, an air flow path extending from the pre-motor filter to the suction motor, a clean air outlet downstream of the suction motor, and a handle. The pre-motor filter has a longitudinal length in the rearward direction that is longer than a transverse length in a direction transverse to the rearward direction. The pre-motor filter housing has first and second rearwardly extending pre-motor filter housing sidewalls and the pre-motor filter has first and second rearwardly extending pre-motor filter sidewalls that are positioned transversely inwardly of the pre-motor filter housing sidewalls. The pre-motor filter sidewalls are an upstream face of the pre-motor filter and the pre-motor filter has an inner cavity that is downstream of the upstream face.

20 Claims, 11 Drawing Sheets

(56) References Cited

U.S. PATENT DOCUMENTS

| | | | |
|---|---|---|---|
| 5,107,567 | A | 4/1992 | Ferrari et al. |
| 5,230,722 | A | 7/1993 | Yonkers |
| 6,113,663 | A | 9/2000 | Liu |
| 6,171,356 | B1 | 1/2001 | Twerdun |
| 6,192,550 | B1 | 2/2001 | Hamada et al. |
| 6,341,404 | B1 | 1/2002 | Salo et al. |
| 6,406,505 | B1 | 6/2002 | Oh et al. |
| 6,775,882 | B2 | 8/2004 | Murphy et al. |
| 6,874,197 | B1 | 4/2005 | Conrad et al. |
| 7,105,035 | B2 | 9/2006 | Oh et al. |
| 7,547,336 | B2 | 6/2009 | Fester et al. |
| 7,601,188 | B2 | 10/2009 | Hwang et al. |
| 7,632,324 | B2 | 12/2009 | Makarov et al. |
| 7,708,789 | B2 | 5/2010 | Fester |
| 7,774,898 | B2 | 8/2010 | Hong et al. |
| 7,867,308 | B2 | 1/2011 | Conrad |
| 7,931,716 | B2 | 4/2011 | Oakham |
| 8,117,712 | B2 | 2/2012 | Dyson et al. |
| 8,146,201 | B2 | 4/2012 | Conrad |
| 8,206,482 | B2 | 6/2012 | Williams et al. |
| 8,296,900 | B2 | 10/2012 | Conrad |
| 8,601,641 | B2 | 12/2013 | Conrad |
| 8,978,198 | B2 | 3/2015 | Conrad |
| 9,027,198 | B2 | 5/2015 | Conrad |
| 9,265,395 | B2 | 2/2016 | Conrad |
| 9,320,401 | B2 | 4/2016 | Conrad |
| 9,433,332 | B2 | 9/2016 | Conrad |
| 9,492,045 | B2 | 11/2016 | Conrad |
| 2002/0092119 | A1 | 7/2002 | Vystrcil et al. |
| 2003/0084536 | A1 | 5/2003 | Yung |
| 2004/0211025 | A1 | 10/2004 | Jung et al. |
| 2005/0132529 | A1 | 6/2005 | Davidshofer |
| 2006/0016042 | A1 | 1/2006 | Bruneau |
| 2006/0254226 | A1 | 11/2006 | Jeon |
| 2006/0257269 | A1 | 11/2006 | Lee et al. |
| 2006/0277712 | A1 | 12/2006 | Kim et al. |
| 2007/0067943 | A1 | 3/2007 | Makarov |
| 2007/0289267 | A1 | 12/2007 | Makarov et al. |
| 2008/0134460 | A1 | 6/2008 | Conrad |
| 2008/0172821 | A1 | 7/2008 | Kang et al. |
| 2008/0178418 | A1 | 7/2008 | Conrad |
| 2008/0196194 | A1 | 8/2008 | Conrad |
| 2008/0196196 | A1 | 8/2008 | Conrad |
| 2008/0196745 | A1 | 8/2008 | Conrad |
| 2008/0263813 | A1 | 10/2008 | Han et al. |
| 2008/0289139 | A1 | 11/2008 | Makarov et al. |
| 2009/0056060 | A1 | 3/2009 | Han et al. |
| 2009/0165431 | A1 | 7/2009 | Oh |
| 2009/0265877 | A1 | 10/2009 | Dyson et al. |
| 2009/0282639 | A1 | 11/2009 | Dyson et al. |
| 2009/0305862 | A1 | 12/2009 | Yoo |
| 2009/0307863 | A1 | 12/2009 | Milne et al. |
| 2010/0212104 | A1 | 8/2010 | Conrad |
| 2010/0229328 | A1 | 9/2010 | Conrad |
| 2010/0236016 | A1 | 9/2010 | Tran |
| 2010/0299866 | A1 | 12/2010 | Conrad |
| 2011/0219572 | A1 | 9/2011 | Conrad |
| 2011/0219575 | A1* | 9/2011 | Conrad ..... A47L 9/0072 15/347 |
| 2012/0023701 | A1 | 2/2012 | Lenkiewicz et al. |
| 2013/0091662 | A1 | 4/2013 | Smith |
| 2013/0232722 | A1* | 9/2013 | Conrad ..... A47L 9/122 15/347 |
| 2014/0237758 | A1 | 8/2014 | Conrad |
| 2014/0237759 | A1 | 8/2014 | Conrad |
| 2016/0015230 | A1* | 1/2016 | Conrad ..... A47L 5/24 15/344 |
| 2016/0120382 | A1 | 5/2016 | Conrad |
| 2016/0213211 | A1 | 7/2016 | Conrad |
| 2016/0367094 | A1* | 12/2016 | Conrad ..... A47L 9/16 |
| 2017/0112339 | A1 | 4/2017 | Conrad |
| 2020/0037836 | A1* | 2/2020 | Paulla ..... B01D 45/16 |

FOREIGN PATENT DOCUMENTS

| | | | |
|---|---|---|---|
| WO | 9930602 | A2 | 6/1999 |
| WO | 2009026709 | A1 | 3/2009 |

* cited by examiner

SURFACE CLEANING APPARATUS

TECHNICAL FIELD

This disclosure relate generally to surface cleaning apparatuses, and, in particular to surface cleaning apparatuses with annular filters.

BACKGROUND

The following is not an admission that anything discussed below is part of the prior art or part of the common general knowledge of a person skilled in the art.

Various types of surface cleaning apparatuses are known. Such surface cleaning apparatuses include vacuum cleaners, including upright vacuum cleaners, hand carriable vacuum cleaners, canister-type vacuum cleaners and Shop-Vac™ type vacuum cleaners. Further, various designs for surface cleaning apparatus filters, including pre-motor filters, are known in the art.

U.S. Pat. No. 9,492,045 disclosures a cylindrical or tubular filter for a surface cleaning apparatus. The filter provides a larger upstream surface area than the downstream filter area. However, the filter is relatively tall and requires a similarly sized filter housing.

SUMMARY

This summary is intended to introduce the reader to the more detailed description that follows and not to limit or define any claimed or as yet claimed invention. One or more inventions may reside in any combination or sub-combination of the elements or process steps disclosed in any part of this document including its claims and figures.

According to one broad aspect, a surface cleaning apparatus, such as a hand vacuum cleaner, is provided with a filter that is annular or substantially annular in shape. The filter, which may be a pre-motor filter, has a hollow interior which provides or is in flow communication with an air flow path downstream from the filter. Accordingly the filter has an outer upstream face and an inner downstream face. The filter has a non-circular cross-sectional area in a direction transverse to a direction of flow though the hollow interior of the filter. In a top plan view (e.g., direction transverse to a direction of flow though the hollow interior), the filer may be oval or generally oval, rectangular or generally rectangular, triangular or generally triangular or the like. Accordingly, the filter may be oblong. Accordingly, the filter may have a squatter shape than a cylindrical filter yet may have the same or an increased upstream surface area, thereby providing enhanced filter life.

In accordance with this aspect, there is provided a hand vacuum cleaner having a front end and a rear end positioned in a rearward direction rearward of the front end, the hand vacuum cleaner comprising:

(a) a dirty fluid inlet provided at the front end;

(b) an air treatment member downstream of the dirty fluid inlet, the air treatment member comprising an air treatment member air inlet and an air treatment member air outlet;

(c) a pre-motor filter positioned in a pre-motor filter housing downstream from the air treatment member, the pre-motor filter having a longitudinal length in the rearward direction that is longer than a transverse length in a direction transverse to the rearward direction, the pre-motor filter housing having first and second rearwardly extending pre-motor filter housing sidewalls, the pre-motor filter having first and second rearwardly extending pre-motor filter sidewalls that are positioned transversely inwardly of the pre-motor filter housing sidewalls and that are an upstream face of the pre-motor filter, and the pre-motor filter has an inner cavity that is downstream of the upstream face;

(d) a suction motor positioned downstream of the pre-motor filter, the suction motor having a suction motor inlet;

(e) an air flow path extending from the pre-motor filter to the suction motor;

(f) a clean air outlet downstream of the suction motor; and, (g) a handle.

In any embodiment, the pre-motor filter may be positioned rearward of the air treatment member air outlet.

In any embodiment, the pre-motor filter may be positioned rearward of the air treatment member.

In any embodiment, the suction motor may be positioned below the pre-motor filter and rearward of the air treatment member.

In any embodiment, the longitudinal length may be more than 1.5 the transverse length.

In any embodiment, the pre-motor filter may be tapered transversely inwardly in the rearward direction.

In any embodiment, a header may be provided forward of the pre-motor filter and the header may have a cross-section flow area that is greater than the cross sectional area of the air treatment member air outlet in a direction transverse to a direction of flow through the air treatment member air outlet, whereby a velocity of air flow in the header is at least 15% less than a velocity of the air flow through the air treatment member air outlet.

In any embodiment, the velocity of air flow in the header may be between 20 and 50% of the velocity of the air flow through the air treatment member air outlet.

In any embodiment, the hand vacuum cleaner may further comprise an openable lid of the pre-motor filter housing.

In any embodiment, an upper surface of the pre-motor filter may be spaced from the openable lid and the upper surface of the pre-motor filter is an upstream face of the pre-motor filter.

In any embodiment, the hand vacuum cleaner may further comprise a pre-motor filter support, the pre-motor filter having support walls which are provided in the cavity of the pre-motor filter and support the pre-motor filter, the support walls having openings therethrough wherein the openings have a cross-sectional area in a direction transverse to a direction of flow through the openings that is at least 10% larger than a cross-sectional area in a direction transverse to a direction of flow through the cavity.

In any embodiment, the cross-sectional area of the openings in the direction transverse to a direction of flow through the openings may be 150 to 300% larger than the cross-sectional area in the direction transverse to the direction of flow through the cavity.

In any embodiment, the suction motor may have an axis of rotation that extends through the pre-motor filter housing.

In any embodiment, the suction motor may have an axis of rotation that extends through at least one of the cavity and the pre-motor filter.

In any embodiment, the hand vacuum cleaner may further comprise a main body having a pre-motor filter support wherein the pre-motor filter support is secured to the main body and the pre-motor filter is removably mounted to the pre-motor filter support.

In any embodiment, the hand vacuum cleaner may further comprise a main body having a pre-motor filter support wherein the pre-motor filter support is non-removably mounted to the main body and the pre-motor filter is removably mounted to the pre-motor filter support.

In any embodiment, the hand vacuum cleaner may further comprise a pre-motor filter support, the pre-motor filter having support walls which are provided in the cavity of the pre-motor filter and support the pre-motor filter, the support walls having openings therethrough wherein the openings have a cross-sectional area in a direction transverse to a direction of flow through the openings that is at least 10% larger than a cross-sectional area in a direction transverse to a direction of flow into the suction motor inlet.

In any embodiment, the cross-sectional area of the openings in the direction transverse to a direction of flow through the openings may be 150 to 300% larger than the cross-sectional area in the direction transverse to the direction of flow through the suction motor inlet.

In accordance with another aspect, there is provided a hand vacuum cleaner having a front end and a rear end positioned in a rearward direction rearward of the front end, the hand vacuum cleaner comprising:

(a) a dirty fluid inlet provided at the front end;

(b) an air treatment member downstream of the dirty fluid inlet, the air treatment member comprising an air treatment member air inlet and an air treatment member air outlet;

(c) an annular pre-motor filter having an inner cavity, the pre-motor filter is positioned in a pre-motor filter housing downstream from the air treatment member, the pre-motor filter housing having first and second rearwardly extending pre-motor filter housing sidewalls and the pre-motor filter is positioned transversely inwardly of the pre-motor filter housing sidewalls;

(d) a header positioned forward of the pre-motor filter, the header has a cross-section flow area that is greater than the cross sectional area of the air treatment member air outlet in a direction transverse to a direction of flow through the air treatment member air outlet, whereby a velocity of air flow in the header is at least 15% less than a velocity of the air flow through the air treatment member air outlet;

(e) a suction motor positioned downstream of the pre-motor filter, the suction motor having a suction motor inlet;

(f) an air flow path extending from the pre-motor filter to the suction motor;

(g) a clean air outlet downstream of the suction motor; and, (h) a handle.

In any embodiment, the velocity of air flow in the header may be between 20 and 50% of the velocity of the air flow through the air treatment member air outlet.

It will be appreciated by a person skilled in the art that an apparatus or method disclosed herein may embody any one or more of the features contained herein and that the features may be used in any particular combination or sub-combination.

These and other aspects and features of various embodiments will be described in greater detail below.

BRIEF DESCRIPTION OF THE DRAWINGS

For a better understanding of the described embodiments and to show more clearly how they may be carried into effect, reference will now be made, by way of example, to the accompanying drawings in which.

Figure 1:
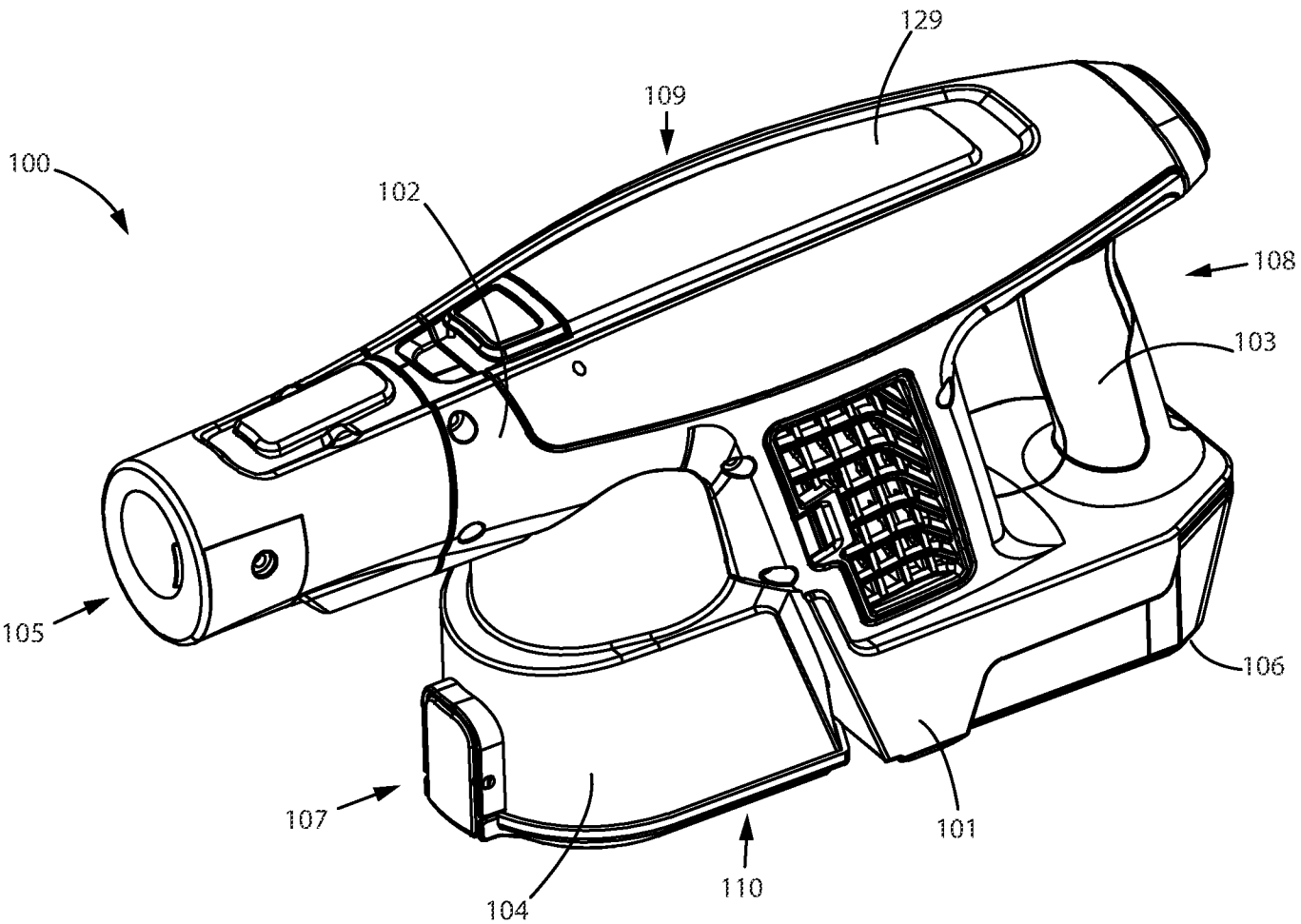
FIG. 1 is a perspective view of a surface cleaning apparatus having a pre-motor annular filter with an openable lid of the surface cleaning apparatus in a closed position, according to one embodiment.

The drawings included herewith are for illustrating various examples of articles, methods, and apparatuses of the teaching of the present specification and are not intended to limit the scope of what is taught in any way.

DETAILED DESCRIPTION

Various apparatuses, methods and compositions are described below to provide an example of an embodiment of each claimed invention. No embodiment described below limits any claimed invention and any claimed invention may cover apparatuses and methods that differ from those described below. The claimed inventions are not limited to apparatuses, methods and compositions having all of the features of any one apparatus, method or composition described below or to features common to multiple or all of the apparatuses, methods or compositions described below. It is possible that an apparatus, method or composition described below is not an embodiment of any claimed invention. Any invention disclosed in an apparatus, method or composition described below that is not claimed in this document may be the subject matter of another protective instrument, for example, a continuing patent application, and the applicant(s), inventor(s) and/or owner(s) do not intend to abandon, disclaim, or dedicate to the public any such invention by its disclosure in this document.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. None of the terms "coupled", "connected", "attached", and "fastened" distinguish the manner in which two or more parts are joined together.

Furthermore, it will be appreciated that for simplicity and clarity of illustration, where considered appropriate, reference numerals may be repeated among the figures to indicate corresponding or analogous elements. In addition, numerous specific details are set forth in order to provide a thorough understanding of the example embodiments described herein. However, it will be understood by those of ordinary skill in the art that the example embodiments described herein may be practiced without these specific details. In other instances, well-known methods, procedures, and components have not been described in detail so as not to obscure the example embodiments described herein. Also, the description is not to be considered as limiting the scope of the example embodiments described herein.

Referring to FIG. 1, illustrated therein is an exemplary embodiment of a surface cleaning apparatus shown generally as 100.

In the illustrated embodiment, the surface cleaning apparatus 100 is a hand vacuum cleaner, which may also be referred to as a "handvac" or "hand-held vacuum cleaner". As used herein, a hand vacuum cleaner is a vacuum cleaner that can be operated to clean a surface generally one-handedly. That is, the entire weight of the vacuum may be held by the same one hand used to direct a dirty air inlet of the vacuum cleaner with respect to a surface to be cleaned. For example, the handle and a clean air inlet may be rigidly coupled to each other (directly or indirectly) so as to move as one while maintaining a constant orientation relative to each other. This is to be contrasted with canister and upright vacuum cleaners, whose weight is typically supported by a surface (e.g. a floor) during use. It will be appreciated that, in other embodiments, the filter disclosed herein may be used in any surface cleaning apparatus.

As exemplified in FIGS. 1 to 12, surface cleaning apparatus 100 includes a main body 101 having a housing 102 and a handle 103, an air treatment member 104 connected to the main body 101, a dirty air inlet 105, a clean air outlet 106, and an air flow path extending between the dirty air inlet and the clean air outlet.

Surface cleaning apparatus 100 has a front end 107, a rear end 108, an upper end or top 109, and a lower end or bottom 110. In the embodiment shown, dirty air inlet 105 is at an upper portion of the front end 107 and clean air outlet 106 is at a rearward portion of the lower end 110. It will be appreciated that the dirty air inlet 105 and the clean air outlet 106 may be provided in different locations.

A suction motor 120 (see e.g. FIG. 4) is provided to generate vacuum suction through the air flow path, and is positioned within a motor housing 119. In the illustrated embodiment, the suction motor 120 is positioned downstream from the air treatment member 104, although it may be positioned upstream of the air treatment member 104 (e.g. a dirty air motor) in alternative embodiments.

Air treatment member 104 is configured to remove particles of dirt and other debris from the air flow entering the surface cleaning apparatus and/or otherwise treat the air flow entering the surface cleaning apparatus. Air treatment member 104 may be any air treatment member known in the cleaning arts. As exemplified, air treatment member 104 may comprise a single cyclonic stage. It will be appreciated that two or more cyclonic stages may be used wherein each cyclonic stage may comprise a single cyclone or a plurality of cyclones in series and one or more dirt collection chambers of any suitable configuration. The dirt collection chamber or chambers may be external to the cyclone chambers, or may be internal the cyclone chamber and configured as a dirt collection area or region within the cyclone chamber. If provided, a second cyclonic cleaning stage may be provided in series in what may be characterized as a 'nested' configuration.

As exemplified in FIGS. 4 and 7 to 9, the air treatment member 104 comprises a single stage cyclone assembly 121 having a single cyclone 122. Cyclone 122 defines a cyclone chamber 134 (the interior of cyclone 122) having a cyclone air inlet 150 (which may be a tangential air inlet), a cyclone air outlet 123 (which may comprise a screen or shroud and a tubular outlet conduit that extends to outlet port 149), a cyclone axis 126 about which air circulates when in the cyclone 122, and a dirt collection chamber 124 to receive dirt separated by the cyclone 122. The dirt collection chamber is exemplified as being exterior to the cyclone chamber 134 and in communication therewith by a dirt outlet 152.

The cyclone 122 may be of various configurations. For example, the cyclone may be an inverted cyclone or a uniflow cyclone (i.e., air may enter one end of a cyclone chamber and exit a second end of the cyclone chamber). As exemplified, the cyclone 122 may have the air inlet and the air outlet provided at one end (e.g., the upper end) and the dirt outlet provided at a second (e.g., lower) opposed end. The air inlet, air outlet and dirt outlet may be of any design known in the cyclone arts.

The cyclone assembly 121 may be formed from any suitable material, including plastic, metal and composite materials, and optionally at least a portion of the cyclone assembly may be transparent to allow a user to see the interior of the cyclone assembly while the hand vacuum 100 is in use.

As exemplified in FIGS. 4 and 7 to 9, cyclone assembly 121 includes a first end wall 130, an opposed second end wall 131 and a sidewall 132 extending therebetween. The cyclone 122 is positioned within the cyclone assembly 121 and includes a cyclone chamber 134 that is generally bounded by a first end wall 135 (which is coincident with first end wall 130), a second opposed end wall 136 and a cyclone sidewall 137 (which is coincident with sidewall 132) extending along a cyclone length 138 (FIG. 4) therebetween. As exemplified, the second end wall 136 may be provided as the top surface of a plate 151 that is connected to, and is opposed to and faces the first end wall 130 of the cyclone assembly 121.

The dirt collection chamber 124 may be defined as a space between a lower surface of plate 151 and an inner surface of opposed second end wall 131. As exemplified, the diameter or cross-sectional area transverse to the cyclone axis of the dirt collection chamber may be greater than that of cyclone 122.

Figure 4:
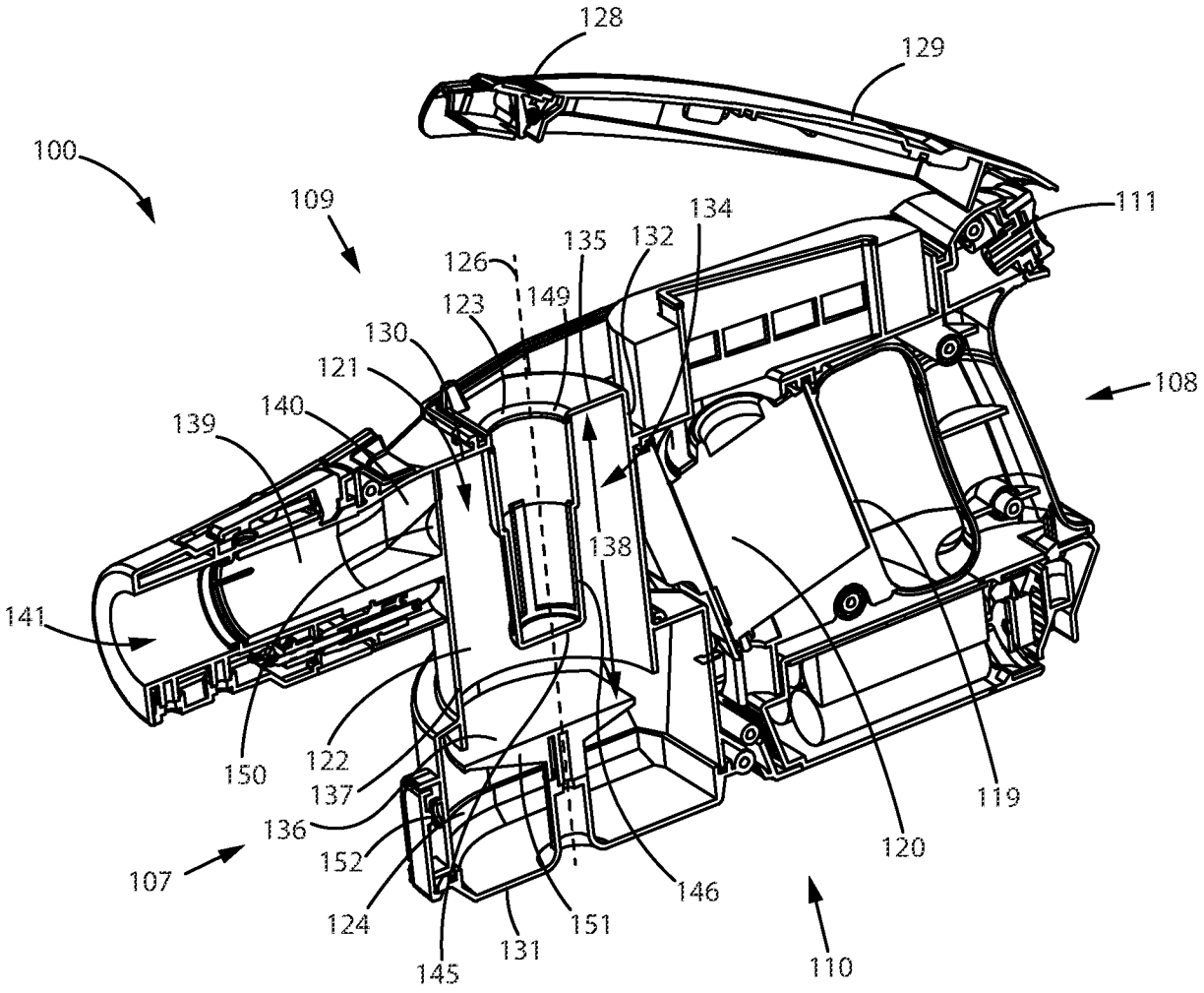
FIG. 4 is a perspective cross-section view along line 4-4 in FIG. 3 of the surface cleaning apparatus of FIG. 1 with the openable lid in the open position.

As exemplified, air enters the first stage cyclone 122 from an air inlet conduit 139 via the air inlet 150 (see e.g. FIG. 4). In the embodiment illustrated, the air inlet 150 is provided in an upper portion of the first cyclone sidewall 137 toward the top end of the cyclone 122 (i.e. proximate to the first end wall 130 of the cyclone assembly 121), but in other embodiments the air inlet 150 may be provided in other locations (e.g. toward the second end wall 131 of the cyclone assembly 121).

As exemplified in FIGS. 4 and 7 to 9, the air inlet conduit 139 may be configured so that it has an inlet/upstream end 141 that is positioned forward of the forward most end wall of at least one of the dirt collection chamber 124. This may help facilitate using the inlet end 141 as a nozzle to directly clean a surface, and/or attaching a wand, hose or other accessory cleaning tool. In the embodiments illustrated, the inlet end 141 extends forwardly of the entire cyclone assembly 121, and is forward of the side wall 132 of the cyclone 122 and the cyclone side wall 137.

As exemplified in the embodiments of FIGS. 1 to 11, a rear/outlet end of the inlet conduit 139 may be the cyclone inlet 150, which may be positioned rearward of the inlet end 141 and is optionally rearward of the forward most end wall of the dirt collection chamber 124. As shown in these embodiments, the inlet conduit 139 may extend generally axially to tangential inlet 150 that extends part way around the cyclone 122. Accordingly, as exemplified in FIG. 4, the outlet end of inlet conduit 139 may be tangential inlet 150, which extends to port 140 in sidewall 137, and which may be positioned rearward of the front end of cyclone 122.

As exemplified in FIG. 4, air may enter cyclone chamber 134 by port 140. The air may then cyclone downwardly towards plate 151 and then reverse direction and travel upwardly to exit cyclone chamber 134 via cyclone air outlet 123. Air may exit cyclone 122 by flowing radially inwardly through a screen (not shown but positionally indicated at 133) that may form part of, or that may itself define, the cyclone air outlet 123.

As exemplified, the cyclone air outlet 123 may be oriented generally parallel or parallel to the first stage cyclone 122 axis, and may be at least partially nested along the length 138 of the cyclone 122 and may be generally co-axial or co-axial to the first stage cyclone 122.

The cyclone air outlet 123 may be of various configurations. As exemplified in FIGS. 3-5, the cyclone air outlet 123 has an end wall 145 that is spaced from plate 151.

In the embodiment exemplified in FIGS. 1 to 11, air exiting the cyclone air outlet 123 travels generally upwardly and then through air outlet port 149 to enter the pre-motor filter housing 156. In the embodiment exemplified in FIGS. 1 to 11, air outlet port 149 faces an inner surface of lid 129. Some air may contact the inner surface of lid 129 prior to travelling rearwardly to pre-motor filter 156. It will be appreciated that lid 129 need not extend over outlet port 149 and that outlet port 149 may be positioned beneath a fixed portion of the housing of the hand vacuum cleaner.

The following is a description of openable pre-motor filter housing 156 and pre-motor filter 157 that may be used in any surface cleaning apparatus or in any combination or sub-combination with any other feature or features described herein.

Pre-motor filter 157 is for removing particles of dirt and other debris from the air and/or otherwise treat the air passing out of the cyclone outlet 123 (i.e. dirt and debris that was not removed from the air in the cyclone chamber 122) prior to the air passing through the suction motor 120. Accordingly, the pre-motor filter 157 is positioned downstream of the air treatment member 104 and downstream of the air outlet port 149. The filter may be made of any filter material known in the art and may be a foam filter. It will be appreciated that the filter may alternately be provided at other locations in the surface cleaning apparatus and need not be a pre-motor filter. For example, it may be a post-motor filter.

Figure 5:
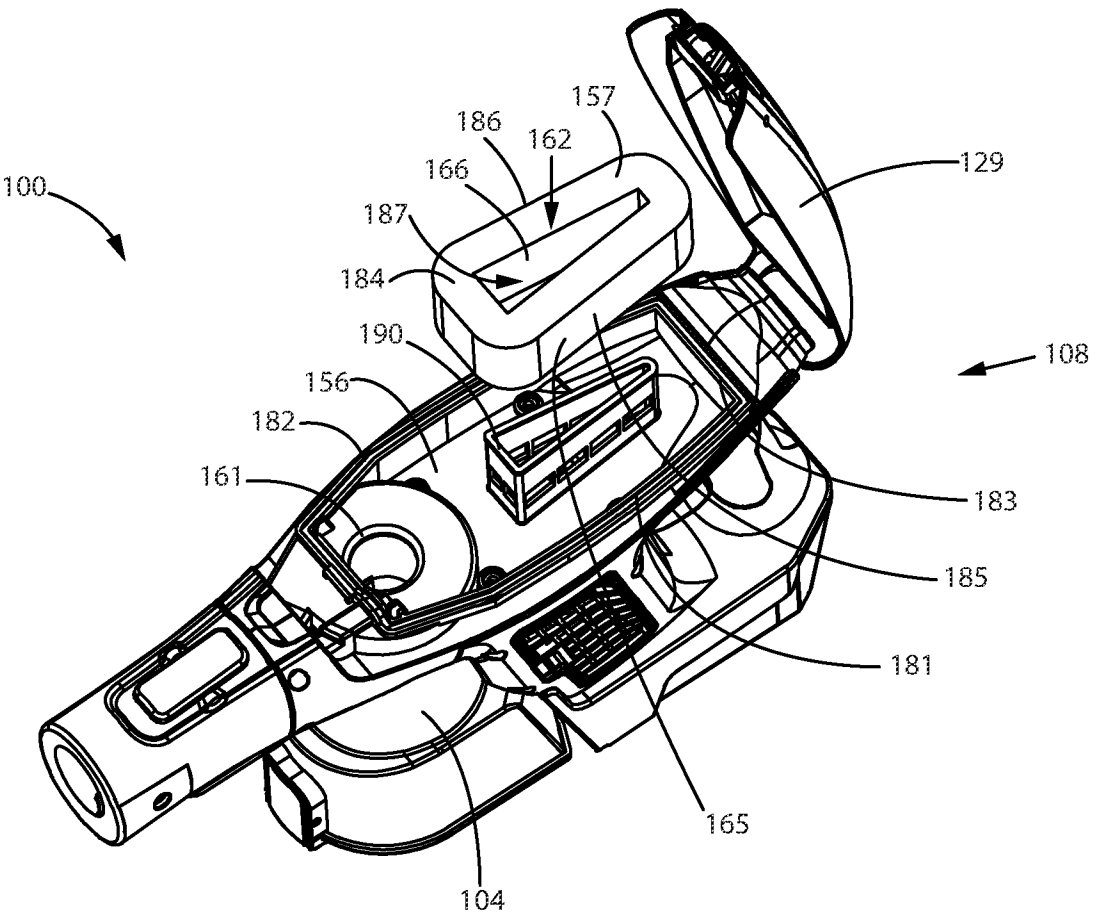
FIG. 5 is a partially exploded perspective view of the surface cleaning apparatus of FIG. 1 with the openable lid in an open position and the annular filter spaced apart from a body of the surface cleaning apparatus.
Figure 6:
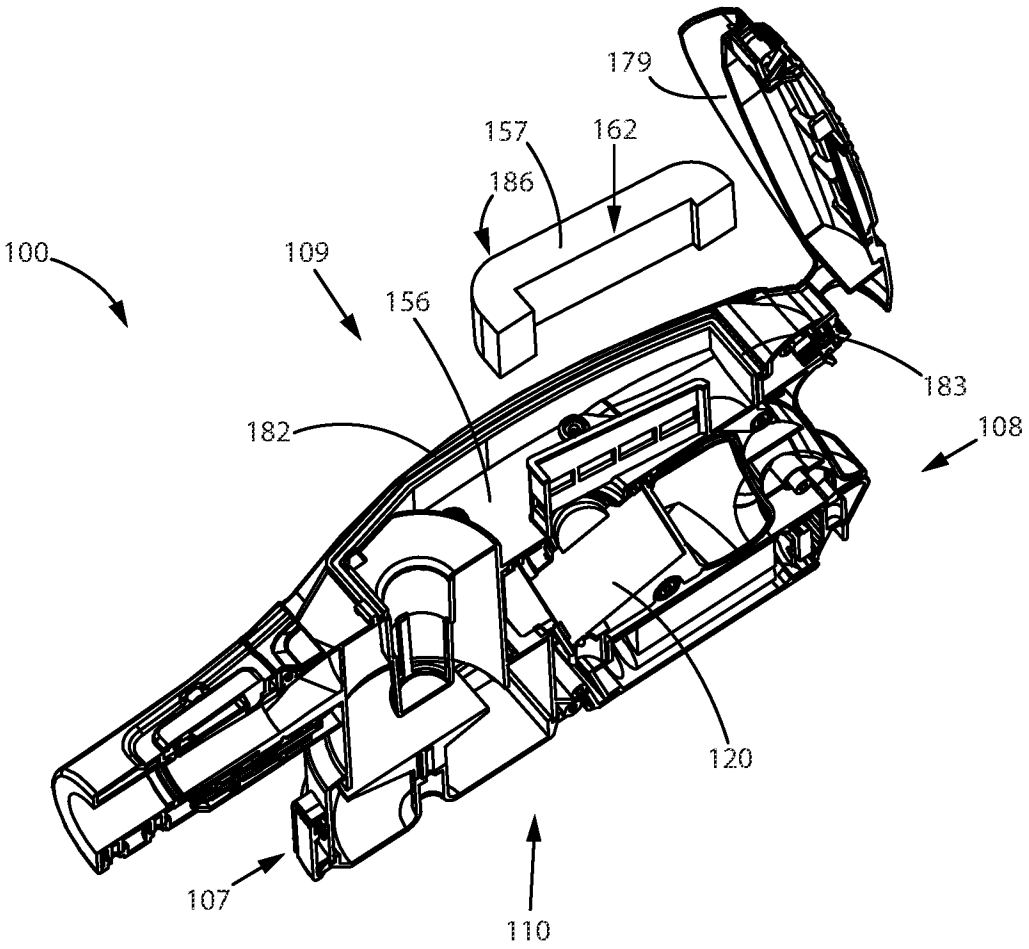
FIG. 6 is a cross-section view along line 4-4 of the exploded perspective view of FIG. 5.

Referring now to FIGS. 5 and 6, pre-motor filter housing 156 is positioned downstream from the air treatment member 104. As exemplified, the pre-motor filter housing 156 may be positioned at an upper end of, and rearward of, air treatment member 104 such that air flowing from the air treatment member 104 to the pre-filter housing 156 travels in a rearward direction. It will be appreciated that the pre-motor filter housing 156 may be provided at any other location and may be partially or completely above the air treatment member. It will also be appreciated that housing 156 need not be a pre-motor filter housing but may house a post motor filter or may house an alternate filter member.

Pre-motor filter housing 156 is configured to house an oblong filter and therefore may itself be of an oblong shape. For example, as exemplified in FIG. 10, filter 157 may be generally triangular in shape with a hollow interior. Accordingly, filter 157 may comprise a plurality of sidewalls (e.g., sidewalls 184, 185, 186) that surround an inner cavity 187 and which extend generally in the direction of air flow through the inner cavity 187. Air enters the filter through the outer or upstream face 165 of filter 157 and exits through the inner or downstream face 166 of filter 157.

Figure 10:
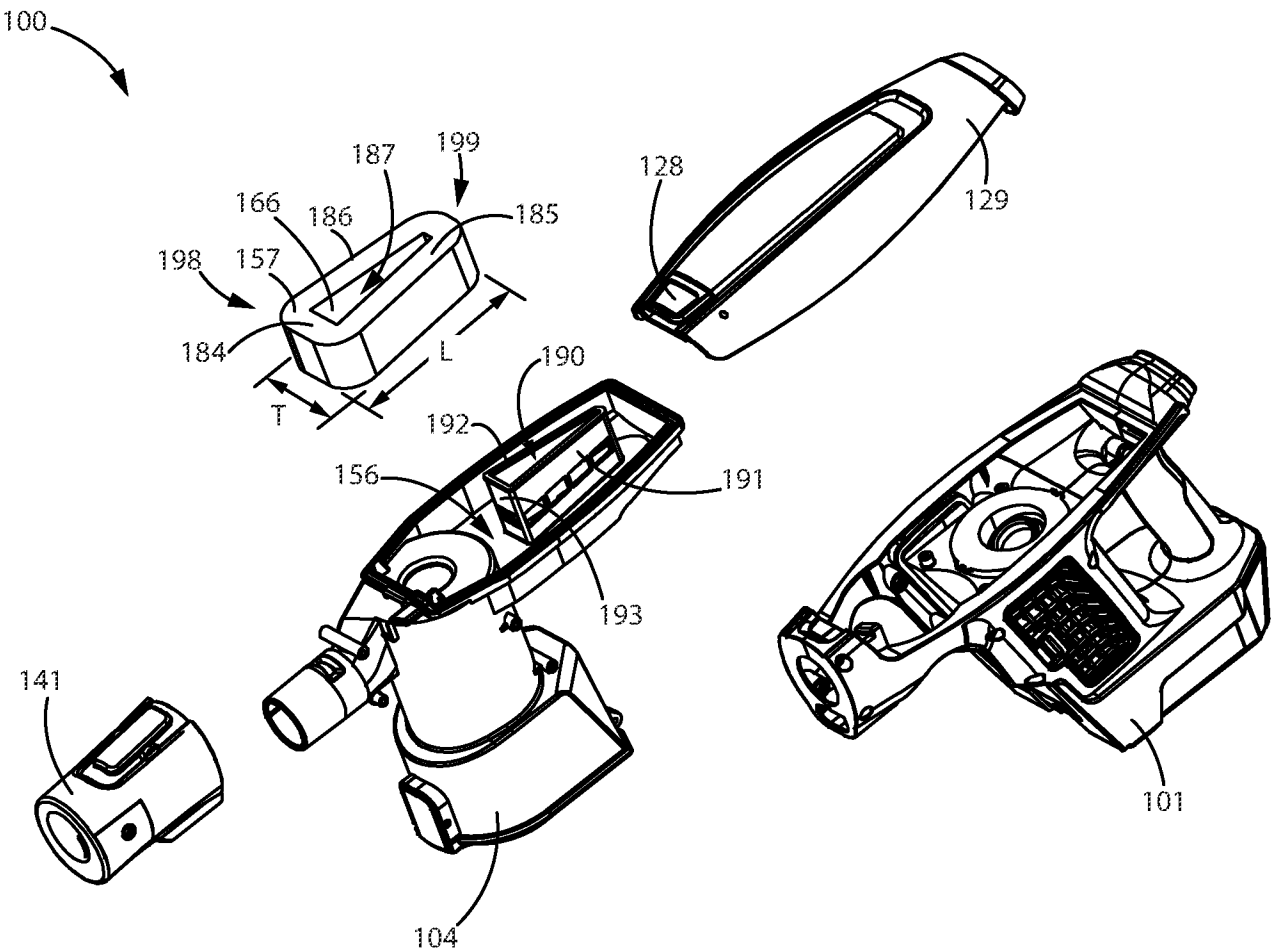
FIG. 10 is an exploded perspective view of the surface cleaning apparatus of FIG. 1 with the nozzle, annular filter, openable lid, body and air treatment member all spaced from each other; and, FIG. 11 is a top plan view of the surface cleaning apparatus of FIG. 1 with the openable lid removed.
Figure 11:
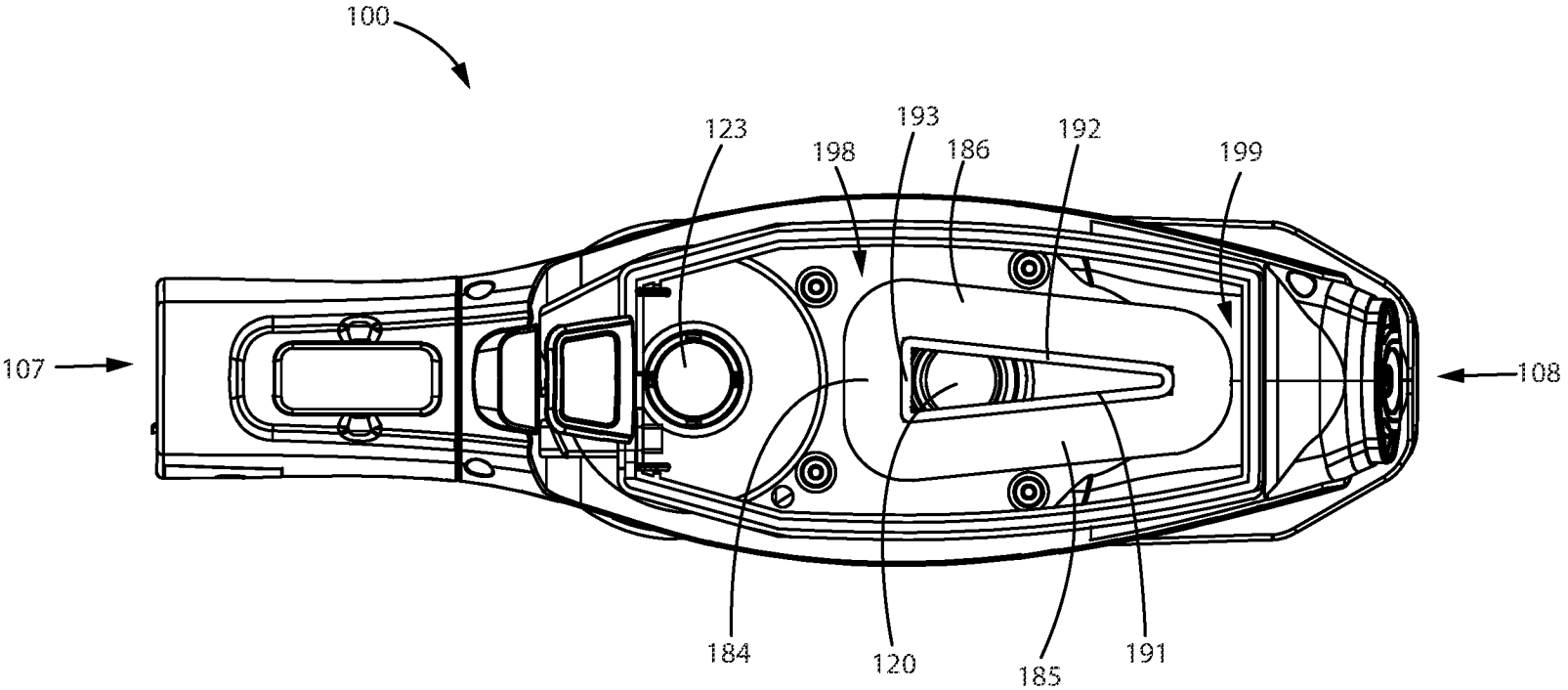

As exemplified in FIG. 10, pre-motor filter 157 has a longitudinal length L in the rearward direction that is longer than a transverse length T in a direction transverse to the rearward direction. The longitudinal length L may be 1.25, 1.5, 1.75, 2, 2.5 or more times the transverse length T. In other embodiments, it will be appreciated that length T may be greater than length L. Accordingly, a volume which may otherwise not be used may be used to accommodate a filter 157 and, therefore, a filter 157 having an increased upstream surface area compared to a cylindrical of planar filter may be provided. This is particularly useful in a small surface cleaning apparatus, such as a hand vacuum cleaner. In any case, it will be appreciated that the longer length of the filter 157 may be greater than a height of the filter in the direction of air flow through inner cavity 187. For example, the longer length "L as exemplified) may be 1.25, 1.5, 1.75, 2, 2.5 or more times the height of the filter in the direction of air flow through inner cavity 187.

In order to permit all of the outer surface 165 of filter 157 to be an upstream (air entry) surface, the walls of the pre-motor filter housing are spaced from the upstream surfaces of the filter 157 through which air enters the filter media (e.g., the sidewalls of the filter 157). It will be appreciated that some, and optionally, all of the walls of the pre-motor filter housing may be spaced from the sidewalls of the filter 157. For example, the upstream surface(s) (face(s)) of the filter 157 may be side face(s) that extend generally parallel to, or parallel to, a direction of air flow through a hollow interior 187 of the filter 157. Accordingly, the walls of the pre-motor filter housing 156 may be spaced from some or all of the upstream face(s) of filter 157. Similarly, the upper surface 162 of filter 157 may be an upstream surface through which air may enter the filter media. Accordingly, an upper wall (e.g., openable lid 129) may be spaced from some or all of the upper surface 162 of the filter.

As exemplified in FIGS. 5 and 6, pre-motor filter housing 156 has a first rearwardly extending pre-motor filter housing sidewall 181 and a second rearwardly extending pre-motor filter housing sidewall 182. Each of first rearwardly extending pre-motor filter housing sidewall 181 and second rearwardly extending pre-motor filter housing sidewall 182 extend rearwardly from a front end of the pre-motor filter housing 156 towards pre-motor filter housing end wall 183 at rear end 108 of the hand vacuum 100.

Figure 2:
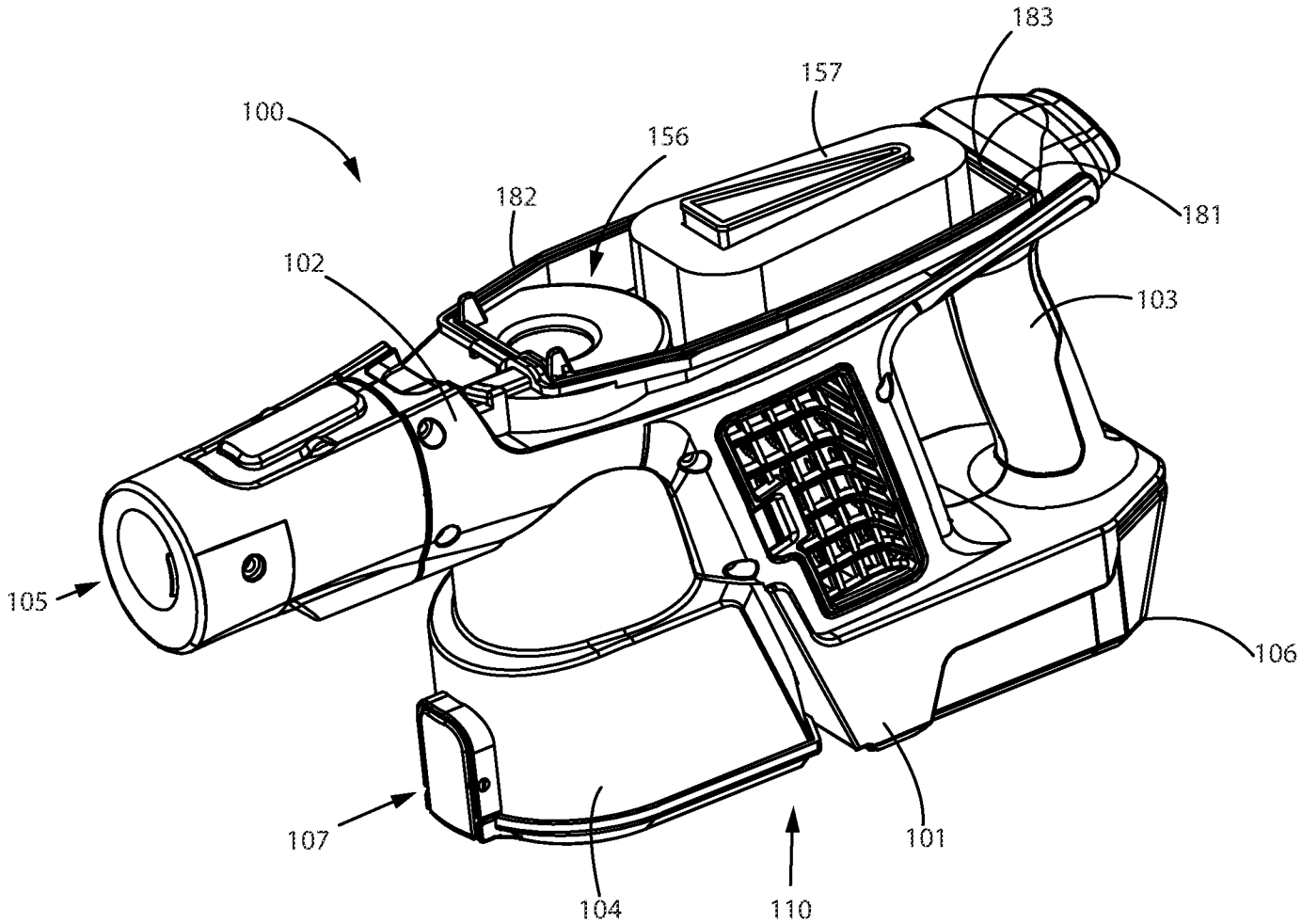
FIG. 2 is a perspective view of the surface cleaning apparatus of FIG. 1 with the openable lid removed.
Figure 3:
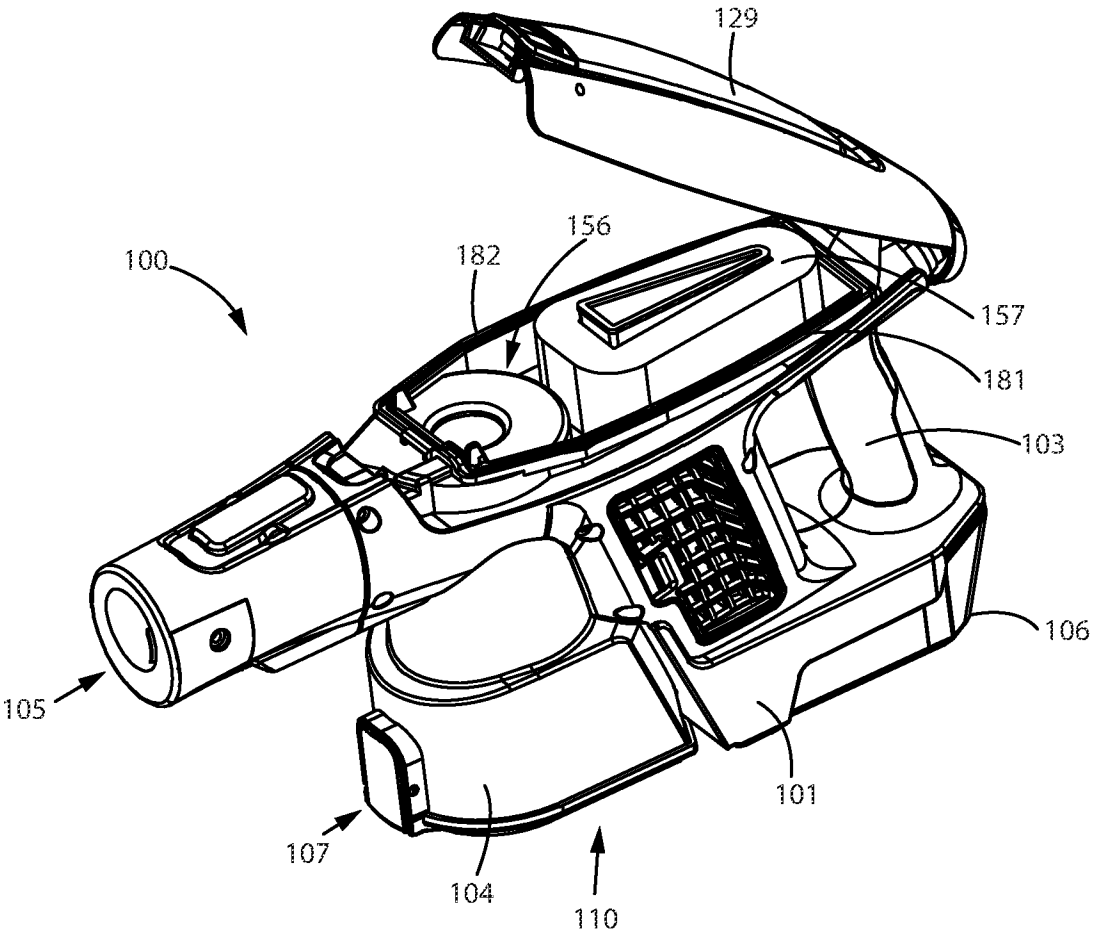
FIG. 3 is a perspective view of the surface cleaning apparatus of FIG. 1 with the openable lid in an open position.

Pre-motor filter housing 156 optionally has an openable lid 129 (see FIGS. 1 to 3). Openable lid 129 is movable between an open position (see FIG. 3) and a closed position (see FIG. 1) so as to provide access to the pre-motor filter 157. Openable lid may be moveably (e.g., pivotally) mounted to, or removably mounted to, the hand vacuum cleaner (e.g., to the pre-motor filter housing). The lid may be secured in a closed position by any securement member known in the mechanical arts. In the embodiment shown in FIGS. 5 and 6, pre-motor filter housing openable lid 129 has a hinge 111 positioned at a rearward portion of the pre-motor filter housing openable lid 129 to provide for the pre-motor filter housing openable lid 129 to be movable between the open position and the closed position. In other embodiments, pre-motor filter housing openable lid 129 may be completely removable from the main body 101 (see FIG. 2). As exemplified, openable lid 129 is retained in the closed position by a latch 128, which may be positioned at the front end 107 (see FIG. 9).

Figure 8:
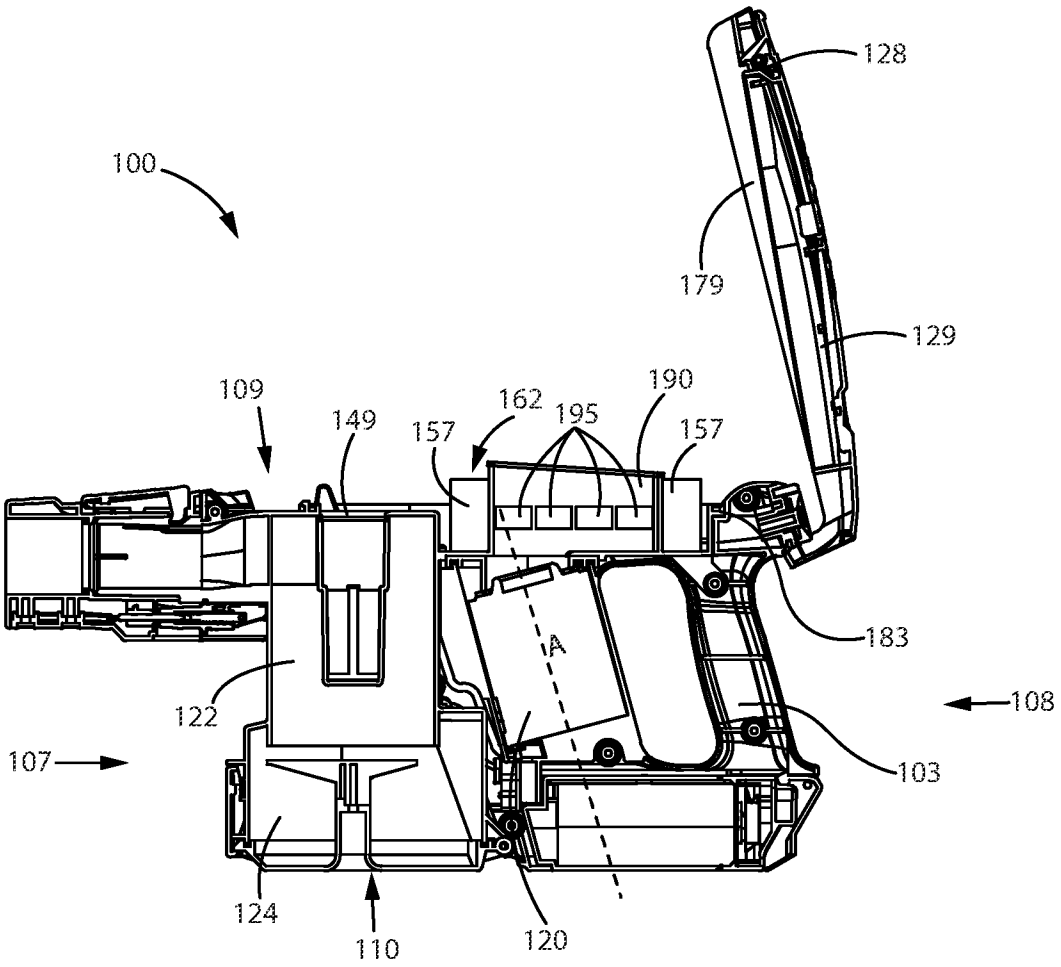
FIG. 8 is a cross-section view along line 4-4 of the surface cleaning apparatus of FIG. 1 with the openable lid in the open position and the annular filter positioned within the surface cleaning apparatus.
Figure 9:
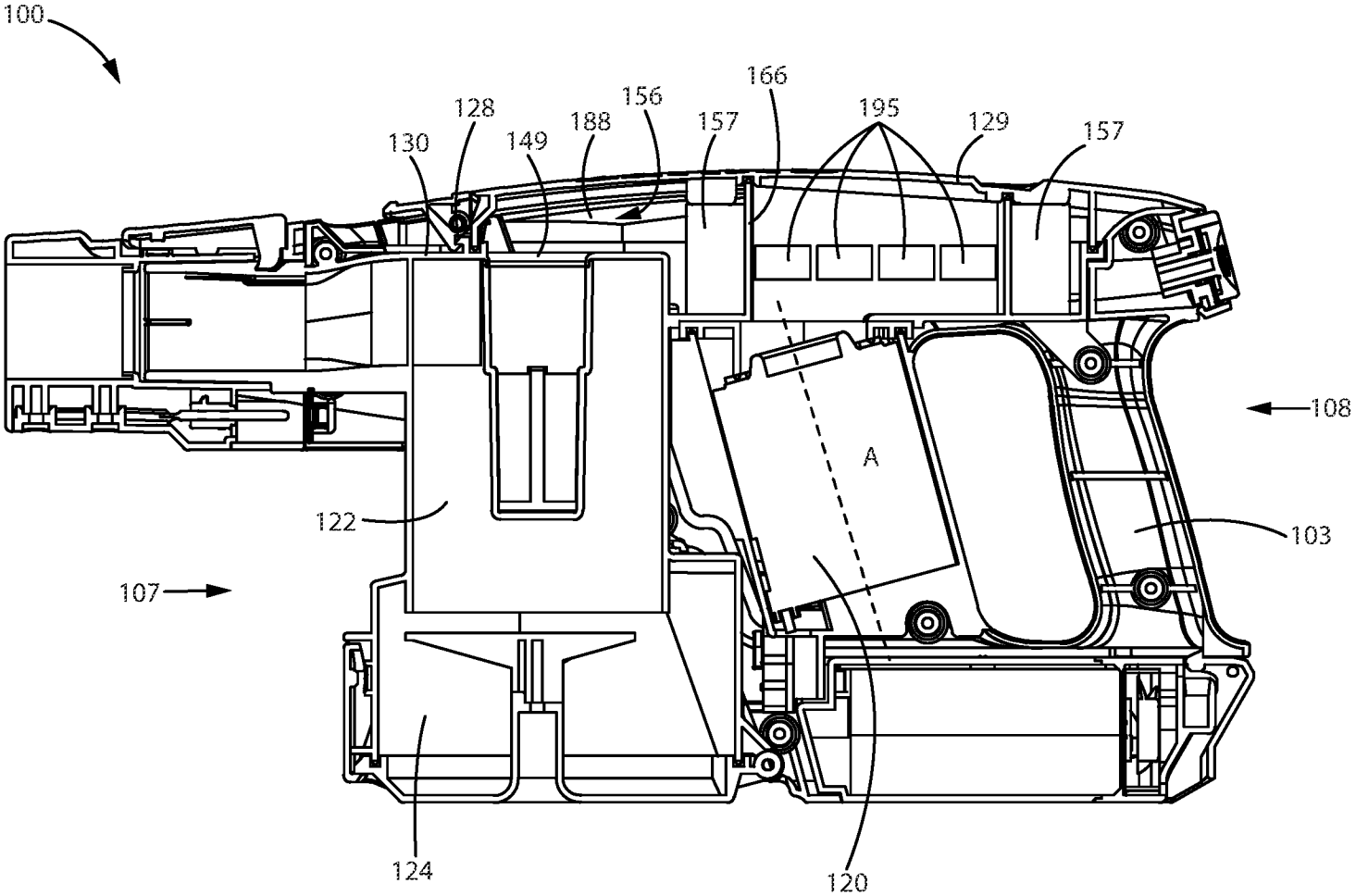
FIG. 9 is a cross-section view along line 4-4 of the surface cleaning apparatus of FIG. 1 with the openable lid in the closed position and the annular filter positioned within the surface cleaning apparatus.

As exemplified in FIG. 9, pre-motor filter housing openable lid 129 may be spaced from (e.g. vertically spaced from) an upper surface 162 of the pre-motor filter 157. In the embodiment shown in the Figures, a bottom surface 179 (see FIGS. 7 and 8) of pre-motor filter housing openable lid 129 is spaced from an upper surface 162 of the pre-motor filter 157. The upper surface 162 of the pre-motor filter 157 may be an upstream face of the pre-motor filter 156.

As exemplified, the chamber of the pre-motor filter housing may be generally triangular in shape. Therefore, as exemplified in FIG. 5, pre-motor filter 157 has a first rearwardly extending pre-motor filter sidewall 185, a second rearwardly extending pre-motor filter sidewall 186. In such an embodiment, sidewalls 185, 186 may be spaced apart at a forward most end 198 of the pre-motor filter 157 and may essentially meet at a rearward most end 199 of the pre-motor filter 157 (e.g., they may be connected by a generally U-shaped segment at the rear end as illustrated).

Each of first rearwardly extending pre-motor filter sidewall 185 and second rearwardly extending pre-motor filter sidewall 186 are positioned laterally inwardly of the first rearwardly extending pre-motor filter housing sidewall 181 and second rearwardly extending pre-motor filter housing sidewall 182 and extend rearwardly from transverse sidewall 184. In the embodiment shown in the Figures, each of first rearwardly extending pre-motor filter sidewall 185 and second rearwardly extending pre-motor filter sidewall 186 extend rearwardly from a forward end of the pre-motor filter housing towards pre-motor filter housing end wall 183 at rear end 108 of the hand vacuum 100 when the pre-motor filter 157 is positioned in the pre-motor filter housing 156. As exemplified, pre-motor filter 157 is tapered transversely inwardly in the rearward direction. As exemplified, rearwardly extending pre-motor filter sidewall 185 may be generally parallel to, or parallel to rearwardly extending pre-motor filter housing sidewall 181 so as to maintain a generally constant or a constant gap therebetween. Similarly, rearwardly extending pre-motor filter sidewall 186 may be generally parallel to, or parallel to rearwardly extending pre-motor filter housing sidewall 182 so as to maintain a generally constant or a constant gap therebetween. Also, transverse sidewall is positioned rearwardly from cyclone 122. Preferably, the sidewalls 184, 185, 186 are positioned sufficiently inwardly from the housing sidewalls so as to act as a header and enable air to travel around an annular air space surrounding filter 157 so as to enter filter 1257 from all sidewalls without creating significant backpressure.

Pre-motor filter 157 has an inner cavity 187 defined by inner surface 166 of the filter 157. As the air flow passes from the cyclone outlet 123 to the suction motor 120, the air flow passes through the filter media of the pre-motor filter 157 and into the cavity 187 and subsequently to suction motor 120. First rearwardly extending pre-motor filter sidewall 185 and second rearwardly extending pre-motor filter sidewall 186 are therefore each an upstream face of the pre-motor filter 157. In some embodiments, upper surface 162 of the pre-motor filter 157 may also be an upstream face of the pre-motor filter 157. Inner cavity 187 is downstream of each of the upstream faces of the pre-motor filter 157, including but not limited to first rearwardly extending pre-motor filter sidewall 185 and second rearwardly extending pre-motor filter sidewall 186.

It will be appreciated that, in alternate embodiments, filter 157 need not be completely annular (e.g., the sidewalls may not define a complete perimeter). For example, a break may be provided in the sidewalls. The filter housing may have walls which about end faces of the filter 157 sidewalls 184, 185, 186 to prevent air bypass. For example, rear end 199 may not have a generally U-shaped segment. Instead the rear end of sidewalls 185, 186 may abut walls of the filter housing to define inner cavity 187.

Pre-motor filter 157 may be secured in pre-motor filter housing by any means known in the art. As exemplified in FIGS. 6-10, a pre-motor filter support 190 that is received in inner cavity 187 is provided to support the pre-motor filter 157. Support 190 preferably secures filter 157 in place, such as by friction (e.g., it may have walls which abut inner surface 166 of the filter 157). However, other securement means may be used, such as flanges the seat over upper surface 162.

The pre-motor filter support 190 may be secured to the main body 101 by any means and may be formed integrally with part thereof. The pre-motor filter 157 may be removably mounted to the pre-motor filter support 190. Alternately, the pre-motor filter may be removable with support 190 or support 190 and filter 157 may each be individually removable.

As exemplified, pre-motor filter support 190 may have a similar shape to the outer upstream surface of the filter 157. In this way, the thickness of the sidewalls 184, 185, 186 may be generally constant. Therefore, pre-motor filter support 190 may have a first rearwardly extending pre-motor filter support wall 191, a second rearwardly extending pre-motor filter support wall 192 and at least one transversely extending pre-motor filter support wall 193. It will be appreciated that the thickness of the sidewalls 184, 185, 186 may vary and therefore the shape of support 190 may vary. Further, if the shape of filter 157 varies, then the shape of support 1290 may also be varied.

Support 190 and inner cavity 187 may be of various shapes, provided that inner surface 166 has a sufficient surface area to enable a pre-determined flow of air therethrough and support 190 has a sufficiently porous structure so as to allow a pre-determined amount of air flow therethrough. In this way, inner surface 166 and support 190 will not limit the air flow through the hand vacuum cleaner. For example, the inner surface 166 and/or the support 190 may permit an air flow therethrough which is about the same as, and optionally equal to or greater than the air flow through the inlet conduit 139 and/or the cyclone air outlet, and/or the suction motor air inlet and/or a post motor filter and/or any air flow conduit in the hand vacuum cleaner.

If the sidewalls extend continuously around inner surface 166, then the sidewalls are porous to permit air to flow therethrough and into inner cavity 187. Alternately, if the sidewalls are discontinuous, e.g., they may be a plurality of discrete spaced apart members such as ribs, then the sidewalls need not be porous as the spacing between the discreet sidewall members may enable sufficient air flow therethrough to reduce or prevent the passage of the air through the sidewalls creating significant back pressure.

Optionally, as exemplified, one or both of the rearwardly extending pre-motor filter support walls 191, 192 and/or the transversely extending pre-motor filter support wall 193 may have openings 195 therethrough. The openings 195 may be generally transverse to a direction of flow of the air flow through the support sidewalls and are sized and shaped to provide for the passage of the air flow through one or more of filter support walls 191, 192, 193.

Optionally, the total cross-sectional area of openings 195 in a direction transverse to a direction of air flow therethrough may be at least 10% larger than a cross-sectional area in a direction transverse to a direction of flow into the suction motor inlet 196.

Alternately, or in addition, the total cross-sectional area of openings 195 in a direction transverse to a direction of air flow therethrough may be at least 10% larger than a cross-sectional area in a direction transverse to a direction of flow through the inner cavity 187.

Alternately, or in addition, the cross-sectional area of the openings 195 in the direction transverse to a direction of flow through the openings is 150 to 300% larger than the cross-sectional area in the direction transverse to the direction of flow through the suction motor inlet.

Alternately, or in addition, the total cross-sectional area of openings 195 in a direction transverse to a direction of air flow therethrough may be 1.1 to 10 times, 1.25 to 6 times or 1.75 to 3 times larger than the cross-sectional area in a direction transverse to a direction of air flow through one or more of the inlet conduit 139, the cyclone air outlet and the suction motor air inlet.

As the air flow passes through the outlet port 149 towards the pre-motor filter 157, the air flow may also pass through a header 188. Header 188 is provided upstream of the pre-motor filter 157 and downstream of air treatment member air outlet 149. In some embodiments, header 188 may be provided upstream and forward of the pre-motor filter 157 and downstream of outlet port 149 (see FIG. 9). In some embodiments, the cross-section flow area of header 188 transverse to a direction of air flow therethrough is greater than a cross sectional area of outlet port 149 in a direction transverse to a direction of flow through outlet port 149. In these embodiments, the air flow in the header 188 may have a velocity that is less than the velocity of the air flow through outlet port 149. In some embodiments, the velocity of the air flow in the header 188 may be at least 15% less than the velocity of the air flow through outlet port 149. In other embodiments, the velocity of the air flow in the header may be between 20 and 50% of the velocity of the air flow through outlet port 149.

Suction motor 120 has a suction motor inlet 197 that is downstream of the pre-motor filter 157. Suction motor inlet 197 is downstream of the inner cavity 187 such that air passes through at least one upstream face of pre-motor filter 157 and cavity 187 prior to passing through the suction motor inlet 197 and into the suction motor 120.

As shown in the embodiments illustrated in the Figures, suction motor 120 may be positioned below the pre-motor filter 157 and rearward of the air treatment member 104.

Figure 7:
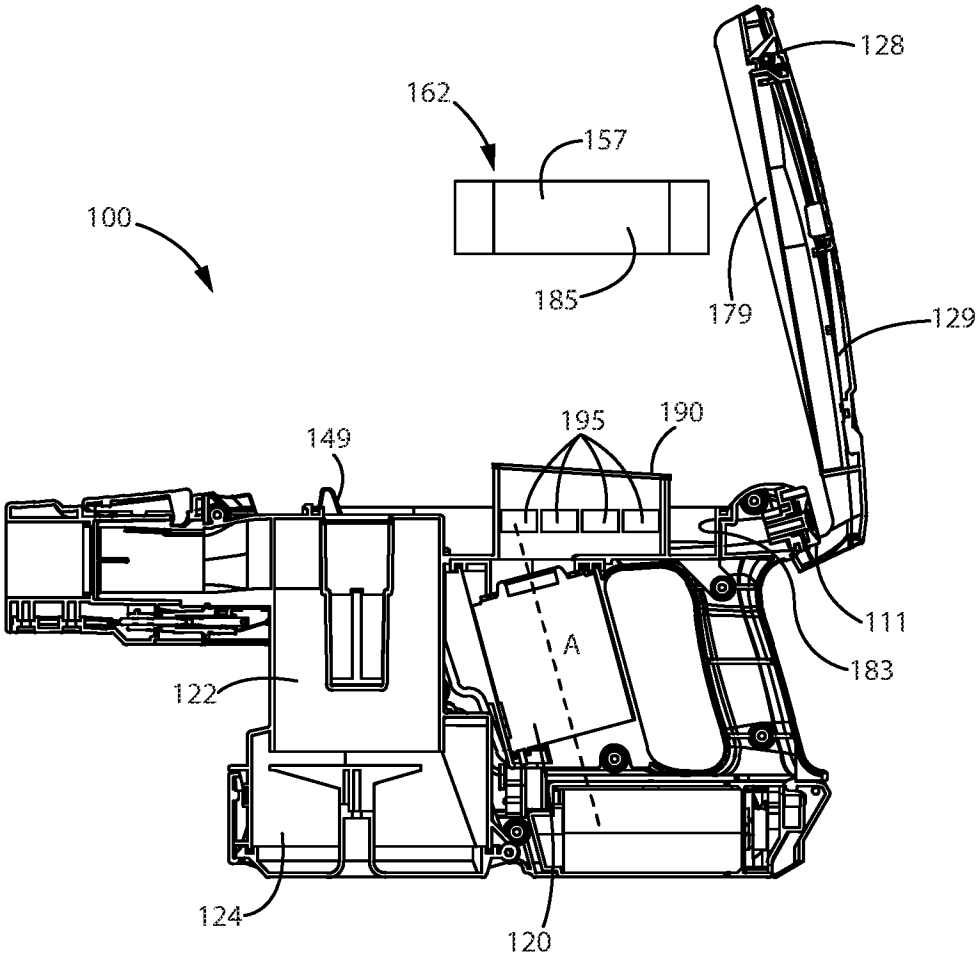
FIG. 7 is a partially exploded cross-section view along line 4-4 of the surface cleaning apparatus of FIG. 1 with the openable lid in the open position and the annular filter spaced apart from a body of the surface cleaning apparatus.

Suction motor 120 has an axis of rotation A (see FIGS. 7 to 9). In some embodiments, the suction motor 120 axis of rotation A may extend through the pre-motor filter housing 156. In some embodiments, axis of rotation A may extend through at least one of the inner cavity 187 and the pre-motor filter 157.

What has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

What is claimed is:

1. A hand vacuum cleaner having an upper end, a lower end, a front end and a rear end positioned in a rearward direction rearward of the front end, the hand vacuum cleaner comprising: a) a dirty fluid inlet provided at the front end; b) an air treatment member downstream of the dirty fluid inlet, the air treatment member comprising an air treatment member air inlet and an air treatment member air outlet provided at an upper end of the air treatment member; c) a pre-motor filter housing comprising a pre-motor filter support, the pre-motor filter support has a hollow interior with an open upper end, wherein a pre-motor filter which has a cavity is positionable on the pre-motor filter support and, when the pre-motor filter is positioned on the pre-motor filter support, the cavity extends around the pre-motor filter support, the pre-motor filter is positioned downstream from the air treatment member and rearward of the air treatment member air outlet, an upper end of the pre-motor filter is positioned above the air treatment member air outlet and a longitudinal length of the pre-motor filter in the rearward direction is longer than a transverse length of the pre-motor filter in a direction transverse to the rearward direction, the pre-motor filter housing having an openable lid moveable between an open position and a closed position and first and second rearwardly extending pre-motor filter housing sidewalls, the pre-motor filter having first and second rearwardly extending pre-motor filter sidewalls that are positioned transversely inwardly of the pre-motor filter housing sidewalls and that are an upstream face of the pre-motor filter; d) a suction motor positioned downstream of the pre-motor filter, below the pre-motor filter and rearward of the air treatment member, the suction motor having a suction motor inlet; e) an air flow path extending from the pre-motor filter to the suction motor and comprising the hollow interior of the pre-motor filter support; f) a clean air outlet downstream of the suction motor; and, g) a handle, wherein a header is provided forward of the pre-motor filter and above the air treatment member; and wherein when the openable lid is in the closed position the openable lid closes the open upper end of the hollow interior of the pre-motor filter support.

2. The hand vacuum cleaner of claim 1 wherein the pre-motor filter is positioned rearward of the air treatment member.

3. The hand vacuum cleaner of claim 1 wherein the longitudinal length is more than 1.5 the transverse length.

4. The hand vacuum cleaner of claim 1 wherein the pre-motor filter is tapered transversely inwardly in the rearward direction.

5. The hand vacuum cleaner of claim 1 wherein the header has a cross-section flow area that is greater than the cross-sectional area of the air treatment member air outlet in a direction transverse to a direction of flow through the air treatment member air outlet, whereby a velocity of air flow in the header is at least 15% less than a velocity of the air flow through the air treatment member air outlet.

6. The hand vacuum cleaner of claim 5 wherein the velocity of air flow in the header is between 20 and 50% of the velocity of the air flow through the air treatment member air outlet.

7. The hand vacuum cleaner of claim 1 wherein an upper surface of the pre-motor filter is spaced from the openable lid when the openable lid is in the closed position and the upper surface of the pre-motor filter is an upstream face of the pre-motor filter.

8. The hand vacuum cleaner of claim 1 wherein the pre-motor filter support comprises support walls which support the pre-motor filter, the support walls having openings therethrough wherein the openings have a cross-sectional area in a direction transverse to a direction of flow through the openings that is at least 10% larger than a cross-sectional area in a direction transverse to a direction of flow through the cavity.

9. The hand vacuum cleaner of claim 8 wherein the cross-sectional area of the openings in the direction transverse to a direction of flow through the openings is 150 to 300% larger than the cross-sectional area in the direction transverse to the direction of flow through the cavity.

10. The hand vacuum cleaner of claim 1 wherein the suction motor has an axis of rotation that extends through at least one of the cavity, the pre-motor filter housing, and the pre-motor filter.

11. The hand vacuum cleaner of claim 1 further comprising a main body having the pre-motor filter support wherein the pre-motor filter support is secured to the main body and the pre-motor filter is removably mounted to the pre-motor filter support.

12. The hand vacuum cleaner of claim 1 further comprising a main body having the pre-motor filter support wherein the pre-motor filter support is non-removably mounted to the main body and the pre-motor filter is removably mounted to the pre-motor filter support.

13. The hand vacuum cleaner of claim 1 wherein the pre-motor filter support comprises support walls which support the pre-motor filter, the support walls having openings therethrough wherein the openings have a cross-sectional area in a direction transverse to a direction of flow through the openings that is at least 10% larger than a cross-sectional area in a direction transverse to a direction of flow into the suction motor inlet.

14. The hand vacuum cleaner of claim 13 wherein the cross-sectional area of the openings in the direction transverse to a direction of flow through the openings is 150 to 300% larger than the cross-sectional area in the direction transverse to the direction of flow through the suction motor inlet.

15. The hand vacuum cleaner of claim 1 wherein the longitudinal length is at least 1.25 times a height of the cavity.

16. The hand vacuum cleaner of claim 1 wherein the cavity has a height from the upper end of the cavity to the lower end of the cavity, the pre-motor filter support has a height from an upper end of the pre-motor filter support to a lower end of the pre-motor filter support, and the height of the cavity is less than the height of the pre-motor filter support.

17. A hand vacuum cleaner having an upper end, a lower end, a front end and a rear end positioned in a rearward direction rearward of the front end, the hand vacuum cleaner comprising:

a) a dirty fluid inlet provided at the front end;

b) an air treatment member downstream of the dirty fluid inlet, the air treatment member comprising an air treatment member air inlet and an air treatment member air outlet provided at an upper end of the air treatment member;

c) an annular pre-motor filter having an inner cavity, the cavity has an upper end that is located at an upper end of the pre-motor filter and a lower end that is located at a lower end of the pre-motor filter, the pre-motor filter is supported by a pre-motor filter support which is positioned in a pre-motor filter housing downstream from the air treatment member, the pre-motor filter support has a height from an upper end of the pre-motor filter support to a lower end of the pre-motor filter support, the pre-motor filter housing having a forwardly facing sidewall portion and first and second rearwardly extending pre-motor filter housing sidewalls and the pre-motor filter is positioned transversely inwardly of the pre-motor filter housing sidewalls wherein the cavity has a height from the upper end of the cavity to the lower end the cavity, the height of the cavity is less than the height of the pre-motor filter support;

d) a header positioned forward of the pre-motor filter and above the air treatment member, the forwardly facing sidewall portion facing the header, the header has a cross-section flow area that is greater than the cross sectional area of the air treatment member air outlet in a direction transverse to a direction of flow through the air treatment member air outlet, whereby a velocity of air flow in the header is at least 15% less than a velocity of the air flow through the air treatment member air outlet;

e) a suction motor positioned downstream of the pre-motor filter, the suction motor having a suction motor inlet;

f) an air flow path extending from the pre-motor filter to the suction motor;

g) a clean air outlet downstream of the suction motor; and, h) a handle.

18. The hand vacuum cleaner of claim 17 wherein the velocity of air flow in the header is between 20 and 50% of the velocity of the air flow through the air treatment member air outlet.

19. The hand vacuum cleaner of claim 17 wherein the longitudinal length is at least 1.25 times the height of the cavity.

20. The hand vacuum cleaner of claim 17 wherein the pre-motor filter support has an interior air flow path having an open upper end, the pre-motor filter housing has an openable lid moveable between an open position and a closed position, wherein the open upper end of the pre-motor filter support is closed when the openable lid is in the closed position.

* * * * *